US010647490B2

(12) United States Patent
Van Der Molen

(10) Patent No.: US 10,647,490 B2
(45) Date of Patent: May 12, 2020

(54) CLOSURE ASSEMBLY

(71) Applicant: Scholle IPN IP BV, SX Tilburg (NL)

(72) Inventor: Peter Jan Van Der Molen, PP Den Haag (NL)

(73) Assignee: Scholle IPN IP BV (NL)

( * ) Notice: Subject to any disclaimer, the term of this patent is extended or adjusted under 35 U.S.C. 154(b) by 0 days.

(21) Appl. No.: 16/606,270

(22) PCT Filed: Apr. 19, 2018

(86) PCT No.: PCT/NL2018/050246
§ 371 (c)(1),
(2) Date: Oct. 18, 2019

(87) PCT Pub. No.: WO2018/194454
PCT Pub. Date: Oct. 25, 2018

(65) Prior Publication Data

US 2020/0047964 A1 Feb. 13, 2020

(30) Foreign Application Priority Data

Apr. 20, 2017 (NL) ..... 2018749

(51) Int. Cl.
*B65D 75/58* (2006.01)
*B65D 47/12* (2006.01)

(52) U.S. Cl.
CPC ..... *B65D 75/5883* (2013.01); *B65D 47/122* (2013.01)

(58) Field of Classification Search
CPC ..... B65D 75/5883; B65D 47/122
USPC ..... 222/548
See application file for complete search history.

(56) References Cited

FOREIGN PATENT DOCUMENTS

| | | |
|---|---|---|
| GB | 371787 | 4/1932 |
| WO | WO 01/56894 | 8/2001 |
| WO | WO 2007/002292 | 1/2007 |
| WO | WO 2016/140668 | 9/2016 |

*Primary Examiner* — Patrick M. Buechner
*Assistant Examiner* — Michael J. Melaragno
(74) *Attorney, Agent, or Firm* — Jovan N. Jovanovic; The Watson IP Group, PLC

(57) ABSTRACT

A closure assembly with a spout having a body with a seal portion and a tubular neck, and, a rotational plastic cap having a top wall, a downward depending skirt and opposite wing parts, extending in a vertical plane from the skirt over a wing part length. The top portion of the wing parts has a top protrusion extending from the base portion. The top protrusion extends substantially in and/or opposed to the opening direction of the cap such that the top portion of the wing parts extends along the wing part length over/outside the base portion thereof in a direction corresponding or opposed to the opening direction, such that, for a cross-section in a vertical plane of the opening direction, the surface area of the at least one top protrusion contributes at least equally to the inertial moment as the surface area of the base portion.

18 Claims, 9 Drawing Sheets

CLOSURE ASSEMBLY

FIELD OF THE INVENTION

The present invention relates to a closure assembly and a container provided with a closure assembly.

BACKGROUND OF THE INVENTION

Closure assemblies are known with a plastic screw cap that is screwed onto a neck, e.g. of a plastic container or of a spout fitted on a collapsible pouch container.

A closure assembly is, for example, known from EP2766279 A1.

OBJECTS OF THE INVENTION

The present invention aims to provide an improved closure assembly, or at least to provide an alternative for known closure assemblies, e.g. allowing to minimize the amount of material making up the closure assembly.

SUMMARY OF THE INVENTION

The present invention achieves the mentioned object by providing a closure assembly, which is characterized in that the top portion of each of the two wing parts of the cap comprises at least one top protrusion extending from the base portion over the height of the top portion, and in a lateral direction along the wing part length over a top protrusion length, and wherein each top protrusion, in a top view of the cap, extends substantially in or opposed to the opening direction of the cap such that in a top view of the cap the top portion of each of the two wing parts extends along the wing part length over or outside the base portion thereof in a direction corresponding and/or opposed to the opening direction, such that along each top protrusion length, for a cross-section in a vertical plane of the opening direction, the surface area of the at least one top protrusion contributes at least equally to the inertial moment as the surface area of the base portion.

The advantage of the present invention lies in that having the wing parts of the cap comprise one or more top protrusions in the opening direction and/or the opposite direction, allows the wing parts to have an acceptable bending stiffness in these directions while the vertical cross-sectional area in these directions is limited. This allows for the wing parts to be made up of less plastic material, while still allowing the same torque to be exerted thereon by the fingers of the user in order to open the cap.

This advantageous effect is based on the insight that the inertial moment of the vertical cross-sections in the mentioned directions progressively increases by providing surface area more remote from the vertical center line of this cross-section, so that an increasingly smaller surface area has the same contribution to the bending stiffness when provided further away from this center line. Therein, the center line is the vertical line through the center of mass of the cross-section. The wing part can thus be made up of less material by having the material extend further in the opening direction and/or the opposed direction without decreasing the torque that can be exerted thereon by the user.

Furthermore, as the cap is to be provided to the top of the spout, the user is envisaged to engage the wing parts while having his hand above the cap, his/her fingers depending downwardly. The engagement points of the forces each finger exerts on the one or more wing parts will generally be at the upper part of the wing parts, so that stiffness is most functional there.

The cap has exactly two wing parts, so to enable the most convenient grip onto these by the fingers of the user. Furthermore in an appropriate embodiment, when the closure assembly—with the cap in its closed position—is provided to a collapsible pouch with a top edge that extends in the lateral direction, this enables the wing parts to extend in a lateral direction parallel to the vertical plane of the top edge of the collapsible pouch. This limits the take-up of space in the direction perpendicular thereto by the combination of the pouch and the closure assembly, so to enable efficient handling, storage and transportation thereof, in particular when handled, stored and/or transported in bulk.

Preferably, the base portion is embodied as a wing panel having its main extension in said vertical direction. In an embodiment the surface of the base portion of each wing part facing the opening direction and that facing the opposed direction is substantially flat, and most preferably does not comprise any substantial relief in, or opposed to, the opening direction. The wing panel may be provided with one or more holes therein when desired.

In a preferred embodiment, in a top view of the cap, the top portion of each wing part has two top protrusions. Of these two top protrusions, one extends along the wing part length outside the base portion in the opening direction and the other one extends along the wing part length in the opposite direction. Therein, preferably, these two top protrusions, together with the wing panel of the base portion, define, seen in a vertical cross-sectional area of the wing part, a Y-shape. Alternatively, along each top protrusion length, a vertical cross-sectional area of the wing part may define a T-shape, so with the two protrusions being in the same horizontal plane and extending in opposite directions from the wing panel shaped base portion.

In another alternative embodiment, the top protrusions, in a top view of the cap, all either extend outside the base portion in the opening direction or all extend outside the base portion in the opposite direction. Therein, along each top protrusion length, a vertical cross-sectional area of the wing part may for instance define an overturned L-shape or a mirrored and overturned L-shape.

Furthermore preferably, the top protrusions, just as the base portion of the wing parts, extend outward from the skirt, particularly such as to link up with the top wall of the cap. This allows for an efficient use of the height of the cap and further favors the optimal transmission of torque from the wing part to the central part of the cap.

Preferably, the height of each of the wing parts decreases in said lateral direction over the wing part length. In particular, preferably the top portion of the each wing part having at least one top protrusion defines a bow shape in the lateral direction along the wing part length. Compared to a wing part that has a substantially uniform height, the so resulting bow or arc shape of the wing parts enables a further reduction of the amount of material making it up while maintaining the bending stiffness, so to further contribute to the advantageous effect of the invention.

Preferably, in a top view of the cap, each top protrusion extends over substantially the whole wing part length. This enables material reduction over substantially the whole wing part length, so to further contribute to the advantageous effect of the invention.

In favor of the functionality of each wing part, its length measured from the skirt is preferably at least 1.5 cm so to allow a finger of a user to engage it. Its length is preferably at most 4.5 cm, so that it does not extend in the lateral direction further than a pouch, e.g. containing a beverage, to which the closure assembly may be provided, e.g. the seal portion being sealed into a top edge seal of the pouch.

WO2014/007612A1 discloses a cap that comprises a tamper-evident ring that is integrally moulded to the skirt. In an embodiment of the cap according to the invention, the cap comprises such a tamper-evident ring. Therein, the tamper-evident ring is composed of at least two ring segments, each ring segment having a base portion and an indicator portion. Therein, the base portion is connected via one or more non-frangible connector portions to the skirt. The base portion extends from a trailing end thereof in the opening direction over a base portion angle about the main axis. The base portion has an inner face with an inner face radius about the main axis.

Furthermore, the indicator portion is integral with the base portion at a junction, and extends from the junction in opening direction over an indicator portion angle about the main axis to a head end of the indicator portion. Therein the indicator portion is connected at the head end thereof via an integrally moulded frangible bridge to an adjacent trailing end of a base portion of another ring segment.

The spout has for each ring segment of the tamper-evident ring a rotation preventing boss. The boss is arranged to be engaged by a corresponding head end of an indicator portion of the segment.

The cap with tamper-evident ring is embodied such that upon rotating the cap in opening direction by the user from its closed position for the first time, the head end of the indicator portion engages the boss. The boss then prevents the head end from further motion in opening direction of the cap, the frangible bridge between said head end and the trailing end of the base portion breaking, and the indicator portion being subjected to permanent deformation.

The boss has a catch portion has a recess at a side of the boss facing the head end of the indicator portion, and has a catch portion outer wall with an outer face that is arranged along the inner face of the base portion near the trailing end thereof when the cap is in its closed position.

The head end of the indicator portion is arranged at a spacing radially inward from the trailing end of the adjacent base portion when the cap is in its closed position. Namely, such that—upon rotating the cap in opening direction by the user from its closed position for the first time—the head end of the indicator portion enters the recess of the catch portion and is then prevented from further motion in opening direction of the cap, whilst the catch portion outer wall comes in the spacing between the spaced apart head end and trailing end, the frangible bridge between said head end and trailing end breaking and the indicator portion bending, folding, and/or buckling whilst being subjected to permanent deformation upon further rotation of the cap in opening direction.

The invention also relates to a closure assembly, wherein each wing part has a base portion embodied as a wing panel and an adjoining top portion with two diverging top protrusions that extend upward from the base portion and diverge from one another defining a Y-shaped vertical cross-section of the wing part together with the base portion. This embodiment may comprise one or more of the features discussed herein with reference to the closure assembly of claim 1.

The present invention also relates to a container, e.g. a collapsible pouch, provided with a closure assembly as described herein. For example, a flexible pouch has a top edge and the spout seal portion is sealed between two pouch walls in a top edge seal of the pouch that extends in the lateral direction, wherein the wings of the cap—in closed position of the cap—extend in said lateral direction parallel to the vertical plane of the top edge of the collapsible pouch.

The invention will now be explained in more detail with reference to the appended drawings.

DETAILED DESCRIPTION OF EMBODIMENTS

Figure 1:
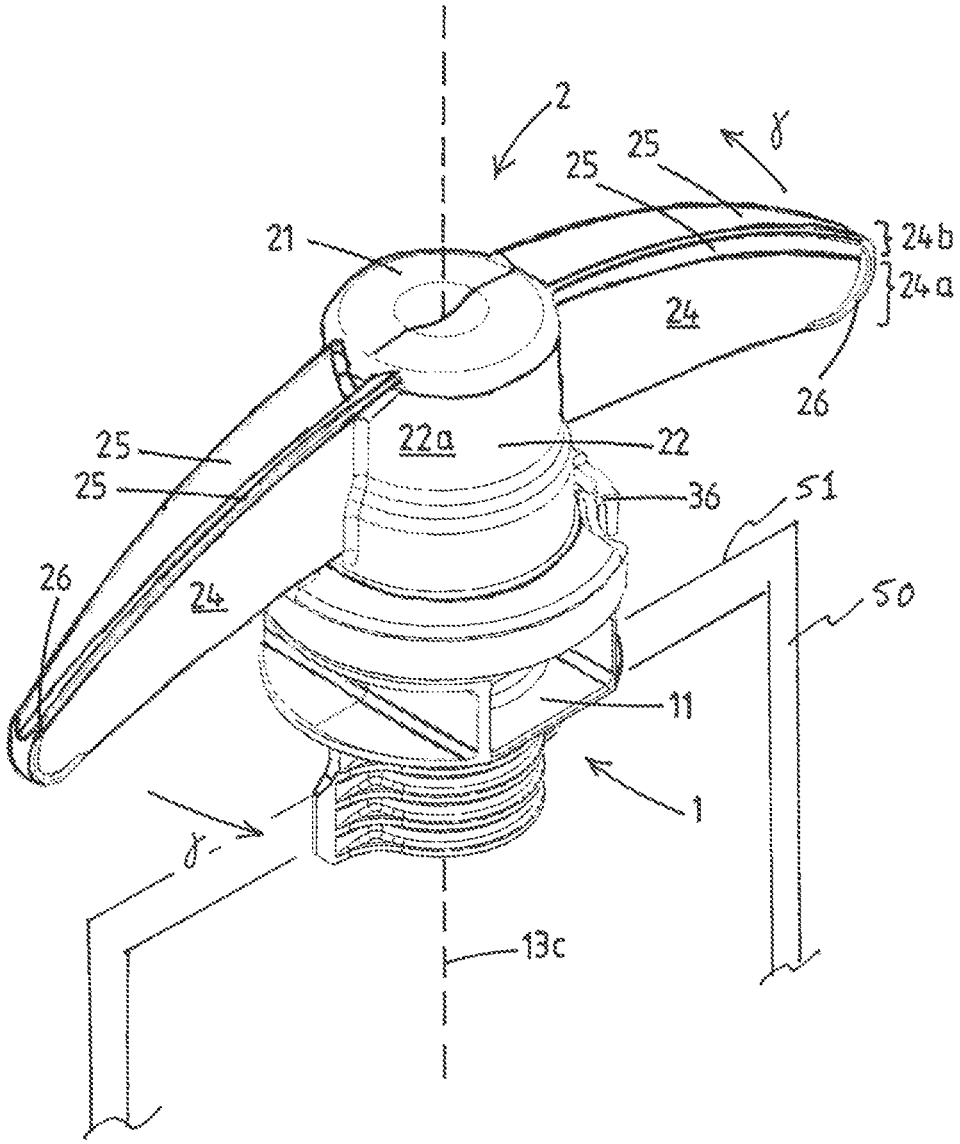
FIG. 1 shows a perspective side view of the closing assembly in a closed position.

FIG. 1 shows a closure assembly according to the invention. The closure assembly comprises a spout 1, and a rotational cap 2.

Figure 2:
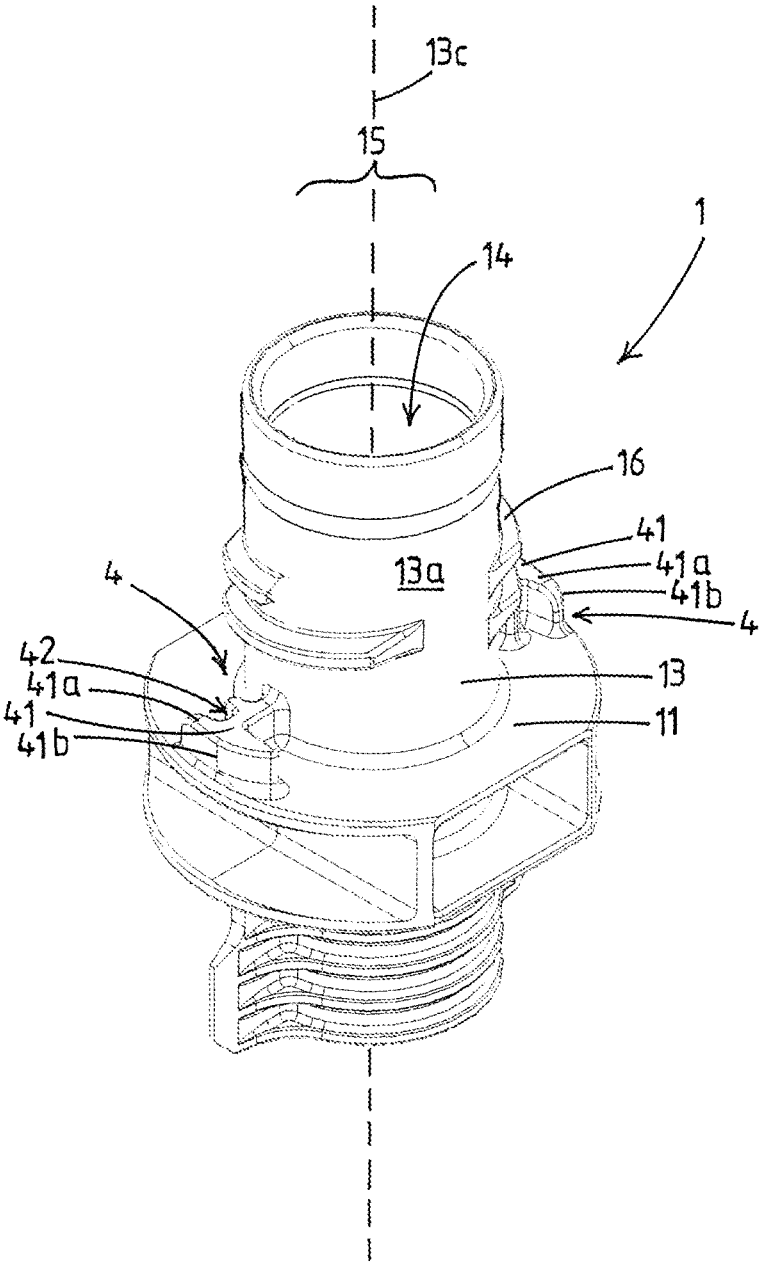
FIG. 2 shows a perspective side view of the spout of the closing assembly.

In FIG. 2, the spout 1 of a closure assembly according to the invention is shown. This spout 1 has a spout body 11 that is injection moulded of plastic material. This spout body 11 has, above a seal portion, a tubular neck 13, wherein a product passage 14 extends through the spout seal portion and the neck of the spout. The tubular neck has a vertical main axis 13*c* and forms a mouth 15 at a top end of said product passage. Furthermore, the neck has an exterior side 13*a*, which has rotational connection members 16. Preferably, as shown, these are embodied as a first screw thread 16 on the neck.

The rotational cap 2 of the closing assembly is injection moulded of plastic material. It is secured on, or is to be secured on, the neck of the spout in a closed position of the cap on the neck, such that the cap seals the product passage. The cap is furthermore adapted to be manually rotated from the closed position, illustrated in FIG. 1, in an opening direction y, for removal of the cap from the neck of the spout by a user to open the product passage.

Figure 3:
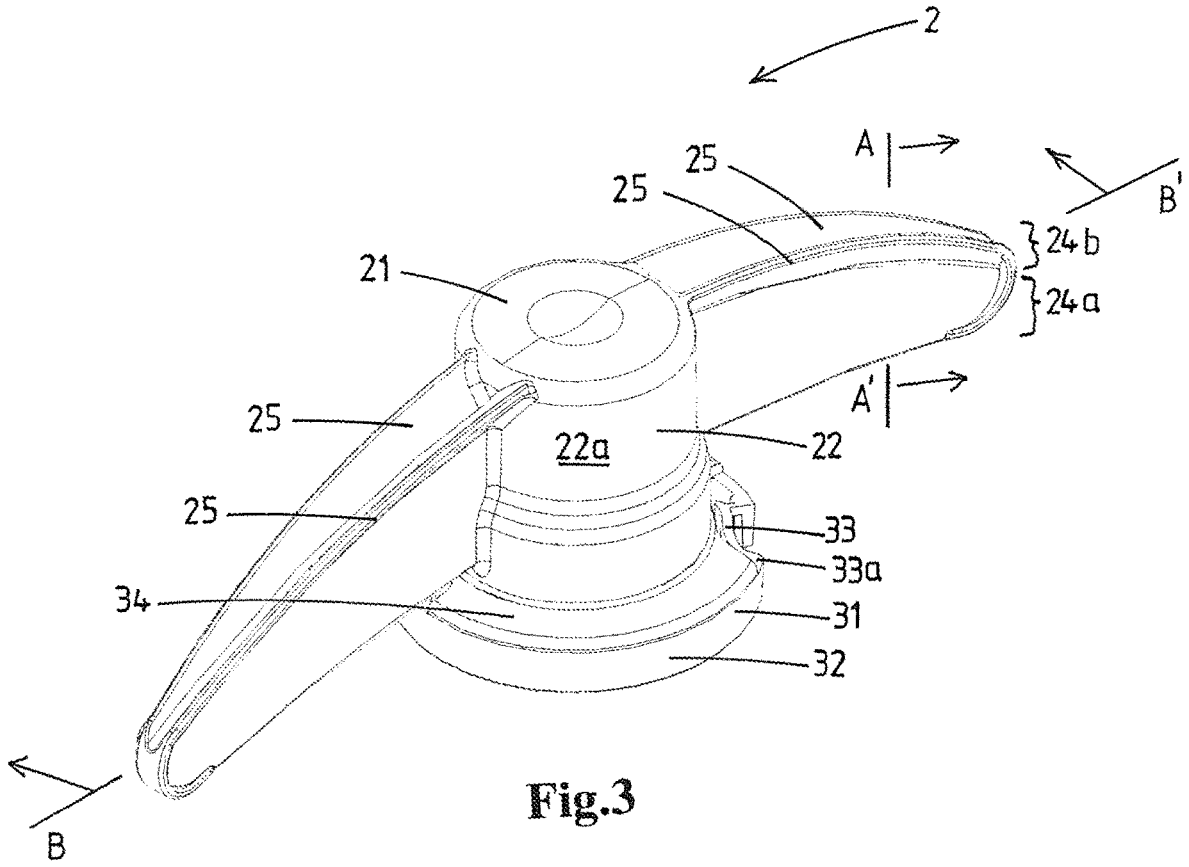
FIG. 3 shows a perspective side view of the cap of the closing assembly.
Figure 4:
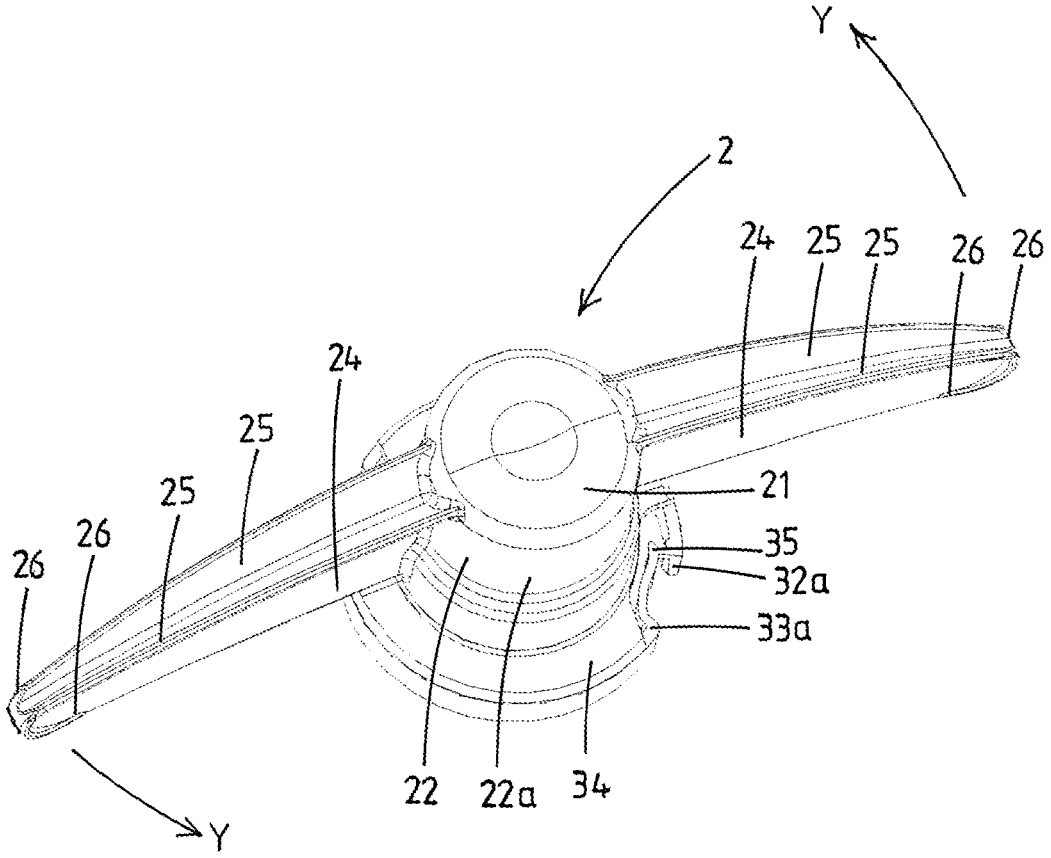
FIG. 4 shows a perspective top view of the cap of the closing assembly.

In FIG. 3 and FIG. 4, perspective views of a rotational cap 2 according to the invention are shown. As indicated, the cap 2 comprises a top wall 21 and a downward depending skirt 22. The skirt has an interior side 22*b*, an exterior side 22*a*, and a lower edge remote from the top wall.

Figure 5:
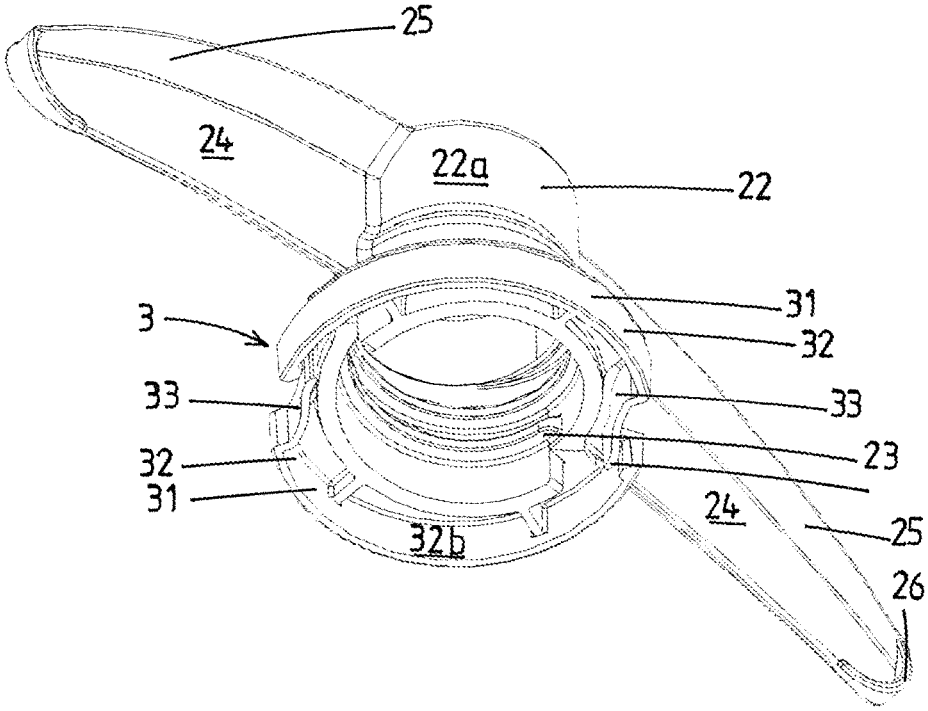
FIG. 5 shows a perspective bottom view of the cap of the closing assembly.

FIG. 5 is a bottom perspective view of the cap 2, which shows the interior of the cap 2. As indicated, the interior side of the skirt has rotational connection members 23. These rotational connection members cooperate with the connection members on the exterior side of the neck of the spout. Preferably, as shown, these are embodied as a second screw thread 23 on the skirt.

As indicated in each of FIGS. 3-8, the cap is provided with, as is preferred, two diametrically opposite wing parts 24, which are each being moulded of plastic material. The wing parts extend outward from said skirt in a lateral direction over a wing part length. Moreover, the wing parts each have a base portion 24*a* and a top portion 24*b*.

The top portion of each of the two wing parts comprises at least one top protrusion 25. This top protrusion extends from the base portion over the height of the top portion, and in a lateral direction along the wing part length over a top protrusion length.

Therein each top protrusion, in a top view of the cap, extends substantially in or opposed to the opening direction of the cap—particularly such that, in a top view of the cap, the top portion of each of the two wing parts extends along the wing part length over or outside the base portion thereof in a direction corresponding or opposed to the opening direction.

More particularly, it extends in this way such that, along each top protrusion length, for a cross-section in a vertical plane of the opening direction, the surface area of the at least one top protrusion contributes at least equally to the inertial moment as the surface area of the base portion.

In the preferred embodiment of the cap shown FIGS. 3-8, the top portion of each of the two wing parts comprises at least two top protrusions. At least one of these extends, in a top view of the cap, along the wing part length outside the base portion in the opening direction. At least another one of the at least two top protrusions extends, in a top view of the cap, along the wing part length outside the base portion in the direction opposite to the opening direction.

Figure 8:
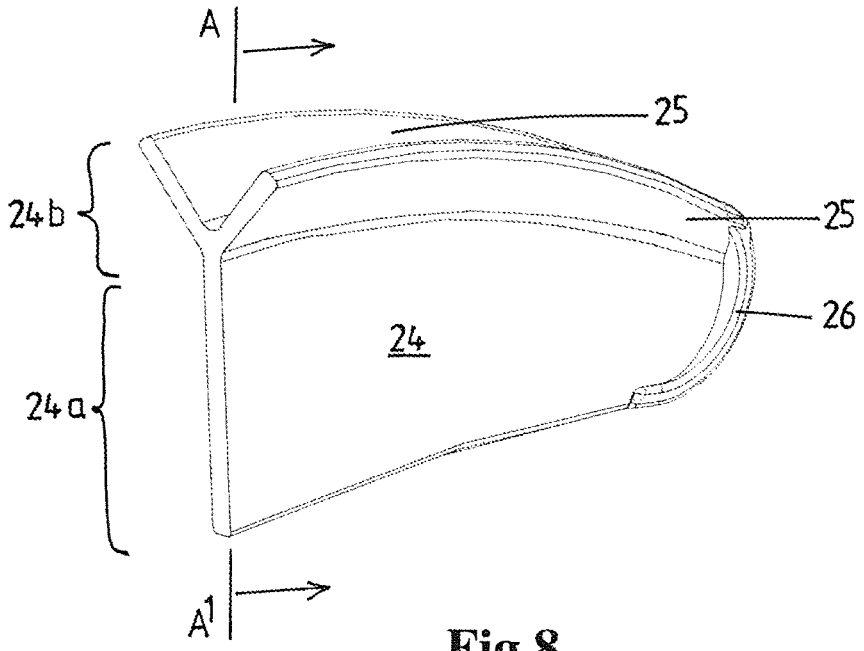
FIG. 8 shows a cross-sectional view of the vertical cut A-A' of the cap.

In FIG. 3, the location of a vertical cut A-A' is indicated, which is shown in FIG. 8 in a perspective view. It can be verified that for this embodiment, as preferred, the vertical cross-sectional area of the wing part defines a Y-shape over the majority or all of the top protrusion length.

Figure 9:
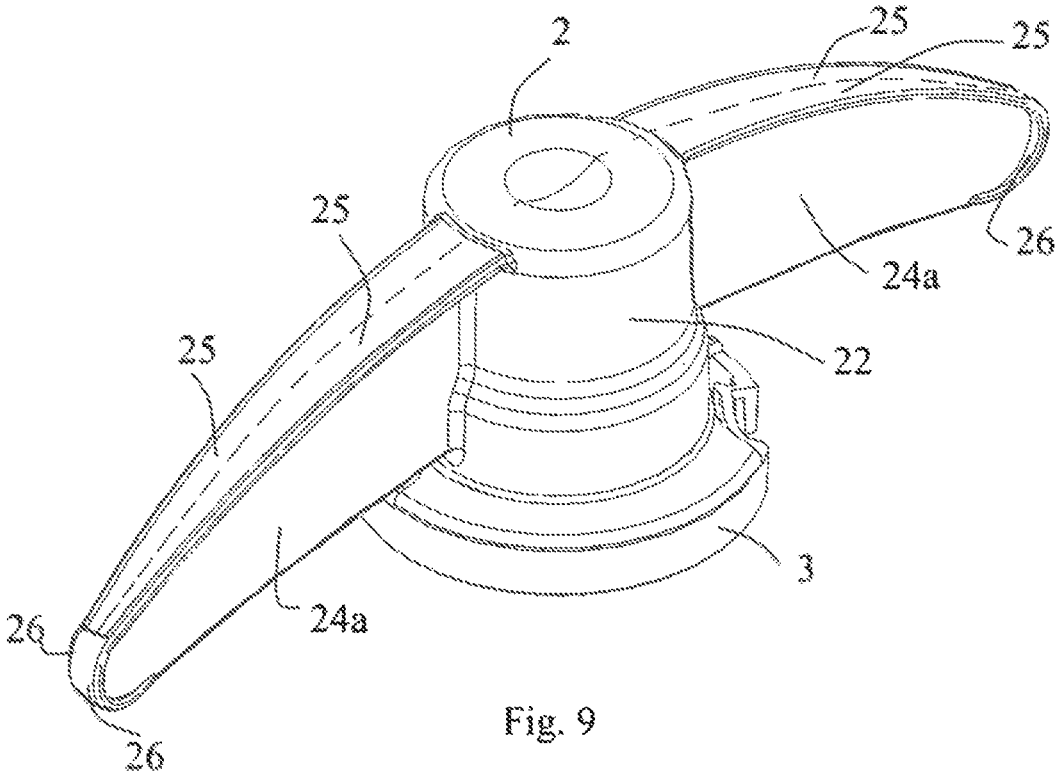
FIG. 9 shows a perspective view of a T-shaped cap of a closing assembly according to the invention.

In alternative example embodiment, a vertical cross-sectional area of the wing part defines a T-shape along each top protrusion length. This is depicted in FIG. 9 wherein the same reference numerals denoted the same or similar components as in the embodiment of FIGS. 1-8. On the top face of the T-shape a broken line indicates the vertical plane of the wing part and delineates the top protrusions 25 that are oppositely directed, preferably symmetrical, relative to said vertical plane. The top face of the T-shape can be flat, but could also have a slight curvature in cross-sectional view.

In another alternative embodiment, the top protrusions, in a top view of the cap, all either extend outside the base portion in the opening direction or all extend outside the base portion in the opposite direction.

Therein, along each top protrusion length, a vertical cross-sectional area of the wing part may for instance define an overturned L-shape or a mirrored and overturned L-shape.

Furthermore preferably, the top protrusions, just like the wing panels of the base portion of the wing parts, extend outward from the skirt, particularly such as to link up directly with the top wall of the cap. This allows for an efficient use of the height of the cap and further favors the torque transmission within the cap.

Figure 7:
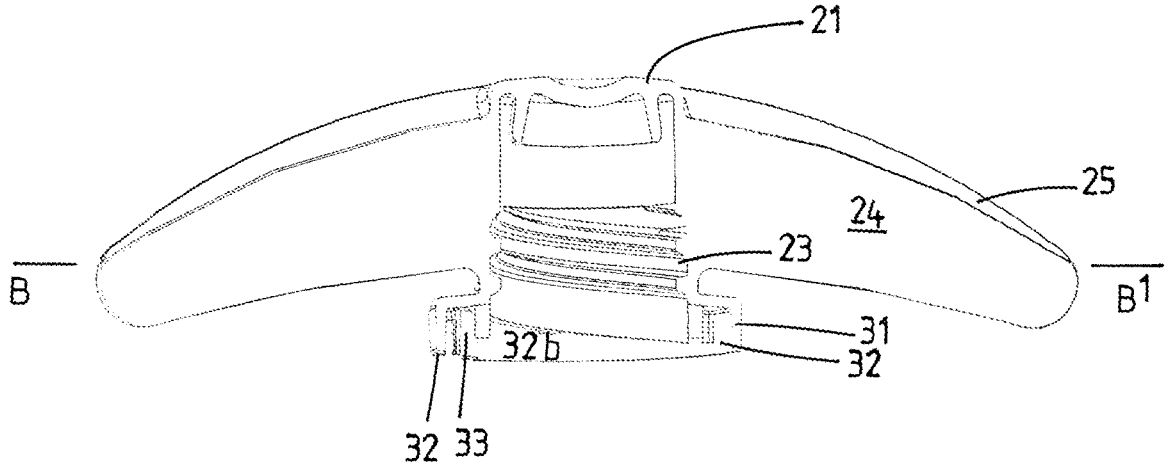
FIG. 7 shows a perspective view of the vertical cut B-B' of a wing part.

In FIG. 3, the location of a vertical cut B-B' is indicated, which is shown in FIG. 7 in a perspective view. It can be verified that for this embodiment, as preferred, the height of each wing part having at least one top protrusion decreases in lateral direction over the wing part length.

As shown in FIG. 7, in this particular embodiment the top portion of each wing part having at least one top protrusion defines a bow shape over the height of the wing parts in the lateral direction along the wing part length.

As can best be verified from the top perspective view of FIG. 4, as is preferred, in a top view of the cap, each top protrusion extends over substantially the whole respective wing part length. In this way, the rigidizing effect of the protrusions relative to the base portion, and the ensued material reduction is maximized in this dimension as well.

Furthermore, a continuous course of the shape of the cross-section along the length, and thus the continuous course of the rigidity along the length enhances the reliability and user-friendliness. At each point along the length the user can expect sufficient rigidity to withstand the torque exerted by the fingers of the user to open and/or close the cap, and no discontinuities interfere with the grip.

In further favor of the functionality and ergonomics, the wing part length is preferably larger than the average width of the thumb, that is, around 1.5 cm, in order to enable the user to engage the wing part during opening and/or closing. In view of the intended minimization of material, the wing part length should preferably still remain limited such that the outer end still makes a relevant contribution to the functionality of the cap. Furthermore, the length preferably does not exceed the length of the pouch the closure assembly is provided on in the lateral direction, to facilitate the transportation thereof. In practice, this would come down to around 4.5 cm.

Figure 6:
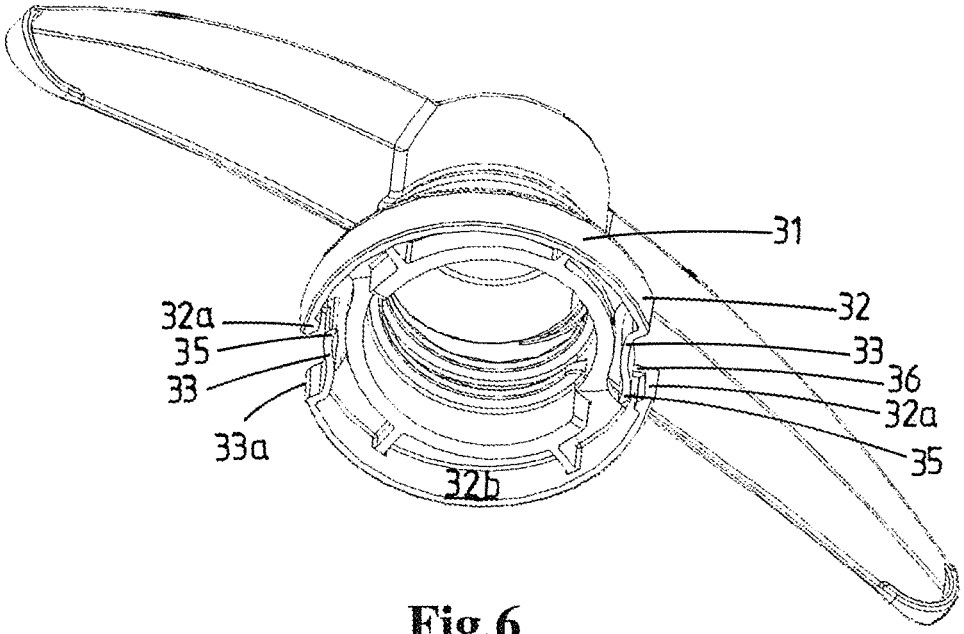
FIG. 6 shows a perspective bottom view of the cap of the closing assembly.

As most clearly visible from FIG. 6 and FIG. 8, in a preferred embodiment of the cap 2 each of the two wing parts further comprises at least one end protrusion 26. This end protrusion 26 extends along the edge of a lateral end of the at least one of the two wing parts over a height of said lateral end, and extends substantially in or opposed to the opening direction of the cap. At the lateral end of a wing part the two end protrusion together, as is preferred, form a rounded end. As preferred the protrusions 26 are curved, seen in plan view on the wing part, wherein the curvature merges into the top protrusion 25 at one end of the curvature and wherein the curvature merges into the lower edge of the wing part at the other end of the curvature. The end protrusions 26 serves to further stabilize the wing part, in particular the lateral end thereof.

As can best be verified from FIGS. 2, 4-6, the embodiment shown therein comprises, as preferred, a tamper-evident ring 3 in accordance with the disclosure of WO2014/007612A1.

This tamper-evident ring 3 is integrally moulded to the skirt. It is composed of at least two ring segments 31. Each ring segment has a base portion 32 and an indicator portion 33.

Therein the base portion is connected via one or more non-frangible connector portions 34 to the skirt, and extends from a trailing end 32*a* thereof in opening direction over a base portion angle about the main axis. It has an inner face 32*b* with an inner face radius about the main axis.

Therein the indicator portion 33 is integral with the base portion at a junction 33*a*. It extends from the junction in opening direction over an indicator portion angle about the main axis to a head end 35 of the indicator portion.

Furthermore the indicator portion 33 is connected at the head end 35 thereof via an integrally moulded frangible bridge 36 to an adjacent trailing end 32*a* of a base portion of another ring segment 31.

As is visible in FIG. 2, the spout has for each ring segment 31 of the tamper-evident ring a rotation preventing boss 4. This boss is arranged to be engaged by a corresponding head end 33*a* of an indicator portion 33 of the segment.

The cap with tamper-evident ring is embodied such that upon rotating the cap in opening direction by the user from its closed position for the first time, the head end of the indicator portion 33 engages the boss. The boss then prevents the head end from further motion in opening direction of the cap, the frangible bridge 36 between said head end 33*a* and the trailing end 32*a* of the base portion breaking, and the indicator portion being subjected to permanent deformation.

The boss 4 has a catch portion 41 having a recess 42 at a side of the boss facing the head end 33*a* of the indicator portion 33. Moreover it has a catch portion outer wall 41*a* with an outer face 41*b*. This outer face is arranged along the inner face 32*b* of the base portion near the trailing end 32*a* thereof, when the cap is in its closed position.

The head end 33*a* of the indicator portion is arranged at a spacing radially inward from the trailing end 32*a* of the adjacent base portion when the cap is in its closed position—namely such that, upon rotating the cap in opening direction by the user from its closed position for the first time, the head end 33*a* of the indicator portion enters the recess 32 of the catch portion. It is then prevented from further motion in opening direction of the cap, whilst the catch portion outer wall 41*a* comes in the spacing between the spaced apart head end 35 and trailing end 32*a*. The frangible bridge 36 between said head end and trailing end breaks and the indicator portion 33 bends, folds, and/or buckles whilst being subjected to permanent deformation upon further rotation of the cap in opening direction.

FIG. 1 schematically illustrates an embodiment wherein, when the closure assembly is provided to a collapsible pouch 50 with a top edge 51 and top edge seal that extends in the lateral direction, the wing parts—of the cap 2 in closed position—extend in a lateral direction parallel to the vertical plane of the top edge 51 of the collapsible pouch 50. This limits the take-up of space in the direction perpendicular thereto by the pouch provided with the closure assembly, so to enable efficient handling, storage and transportation thereof, in particular when handled, stored and/or transported in bulk.

The invention claimed is:

1. A closure assembly comprising:

a spout having a spout body that is injection moulded of plastic material, said spout body having, above a seal portion thereof, a tubular neck, wherein a product passage extends through the seal portion and the tubular neck of the spout, said tubular neck having a vertical main axis and forming a mouth at a top end of said product passage, said neck having an exterior side;

a rotational cap that is injection moulded of plastic material and that is secured on or is to be secured on said neck of the spout in a closed position of the cap on said neck such that the cap seals the product passage, and the cap, for removal of the cap from the neck of the spout by a user to open the product passage, being adapted to be manually rotated from the closed position in an opening direction;

wherein the cap comprises a top wall and a downward depending skirt, said skirt having an interior side, an exterior side, and a lower edge remote from the top wall, wherein the exterior side of the neck and the interior side of the skirt have cooperating rotational connection members, wherein the cap has two diametrically opposite wing parts, which are integrally moulded of plastic material and extend in a vertical plane and outward from said skirt in a lateral direction over a wing part length, and which wing parts each have a base portion and a top portion, wherein the top portion of each of the two wing parts comprises at least one top protrusion extending from the base portion over a height of the top portion, and in a lateral direction along the wing part length over a top protrusion length, and wherein each top protrusion, in a top view of the cap, extends substantially in or opposed to the opening direction of the cap such that in said top view of the cap the top portion of each of the two wing parts extends along the wing part length over or outside the base portion thereof in a direction corresponding and/or opposed to the opening direction, such that along each top protrusion length, for a cross-section in a vertical plane of the opening direction, the surface area of the at least one top protrusion contributes at least equally to the inertial moment as the surface area of the base portion.

2. The closure assembly according to claim 1, wherein the top portion of each of the two wing parts comprises at least two top protrusions, at least one of which extends, in a top view of the cap, along the wing part length outside the base portion in the opening direction, and at least another one of which at least two top protrusions extends, in a top view of the cap, along the wing part length outside the base portion in the direction opposite to the opening direction.

3. The closure assembly according to claim 2, wherein along each top protrusion length, a vertical cross-sectional area of the wing part defines a Y-shape.

4. The closure assembly according to claim 2, wherein along each top protrusion length, a vertical cross-sectional area of the wing part defines a T-shape.

5. The closure assembly according to claim 1, wherein the height of each wing part having at least one top protrusion decreases in lateral direction over the wing part length.

6. The closure assembly according to claim 5, wherein the top portion of each wing part having at least one top protrusion defines a bow shape over the height of the wing part in the lateral direction along the wing part length.

7. The closure assembly according to claim 1, wherein, in a top view of the cap, each top protrusion extends over substantially the whole wing part length.

8. The closure assembly according to claim 1, wherein the wing part length is between 1.5 and 4.5 cm measured from the skirt.

9. The closure assembly according to claim 1, wherein each of the two wing parts further comprises at least one end protrusion, each of which extends along the edge of a lateral end of each of the two wing parts over a height of said lateral end, and each of which extends substantially in and/or opposed to the opening direction of the cap.

10. The closure assembly according to claim 1, wherein the cap furthermore comprises a tamper-evident ring that is integrally moulded to the skirt, said tamper-evident ring being composed of at least two ring segments, each ring segment having a base portion and an indicator portion, wherein the base portion is connected via one or more non-frangible connector portions to the skirt, said base portion extending from a trailing end thereof in opening direction over a base portion angle about the main axis, said base portion having an inner face with an inner face radius about the main axis, and wherein the indicator portion is integral with the base portion at a junction and extends from the junction in opening direction over an indicator portion angle about the main axis to a head end of the indicator portion, wherein the indicator portion is connected at the head end thereof via an integrally moulded frangible bridge to an adjacent trailing end of a base portion of another ring segment, wherein the spout has for each ring segment of the tamper-evident ring a rotation preventing boss, said boss being arranged to be engaged by a corresponding head end of an indicator portion of the segment, wherein the cap with tamper-evident ring is embodied such that upon rotating the cap in opening direction by the user from its closed position for the first time, the head end of the indicator portion engages the boss which then prevents the head end from further motion in opening direction of the cap, the frangible bridge between said head end and the trailing end of the base portion breaking, and the indicator portion being subjected to permanent deformation, wherein the boss has a catch portion having a recess at a side of the boss facing the head end of the indicator portion and having a catch portion outer wall with an outer face that is arranged along the inner face of the base portion near the trailing end (32*a*) thereof when said cap is in its closed position, and wherein the head end of the indicator portion is arranged at a spacing radially inward from the trailing end of the adjacent base portion when said cap is in its closed position, such that, upon rotating the cap in opening direction by the user from its closed position for the first time, the head end of the indicator portion enters the recess of the catch portion and is then prevented from further motion in opening direction of the cap, whilst the catch portion outer wall comes in the spacing between the spaced apart head end and trailing end, the frangible bridge between said head end and trailing end breaking and the indicator portion bending, folding, and/or buckling whilst being subjected to permanent deformation upon further rotation of the cap in opening direction.

11. A closure assembly comprising:

a spout having a spout body that is injection moulded of plastic material, said spout body having, above a seal portion thereof, a tubular neck, wherein a product passage extends through the seal portion and the tubular neck of the spout, said tubular neck having a vertical main axis and forming a mouth at a top end of said product passage, said neck having an exterior side;

a rotational cap that is injection moulded of plastic material and that is secured on or is to be secured on said neck of the spout in a closed position of the cap on said neck such that the cap seals the product passage, and the cap, for removal of the cap from the neck of the spout by a user to open the product passage, being adapted to be manually rotated from the closed position in an opening direction;

wherein the cap comprises a top wall and a downward depending skirt, said skirt having an interior side, an exterior side, and a lower edge remote from the top wall, wherein the exterior side of the neck and the interior side of the skirt have cooperating rotational connection members, wherein the cap has two diametrically opposite wing parts, which are integrally moulded of plastic material and extend in a vertical plane outward from said skirt in a lateral direction over a wing part length, wherein each wing part has a base portion embodied as a wing panel and an adjoining top portion with two diverging top protrusions that extend upward from the base portion and diverge from one another defining a Y-shaped vertical cross-section of the wing part together with the base portion.

12. A container provided with a closure assembly according to claim 1.

13. A collapsible pouch provided with a closure assembly according to claim 1, wherein the pouch has a top edge and wherein the spout seal portion is sealed between two pouch walls in a top edge seal of the pouch that extends in the lateral direction, wherein the wings parts of the cap, in said closed position of the cap, extend in said lateral direction and parallel to a vertical plane of the top edge of the collapsible pouch.

14. A closure assembly comprising:

a spout having a spout body that is injection moulded of plastic material, said spout body having, above a seal portion thereof, a tubular neck, wherein a product passage extends through the seal portion and the tubular neck of the spout, said tubular neck having a vertical main axis and forming a mouth at a top end of said product passage, said neck having an exterior side;

a rotational cap that is injection moulded of plastic material and that is secured on or is to be secured on said neck of the spout in a closed position of the cap on said neck such that the cap seals the product passage, and the cap, for removal of the cap from the neck of the spout by a user to open the product passage, being adapted to be manually rotated from the closed position in an opening direction;

wherein the cap comprises a top wall and a downward depending skirt, said skirt having an interior side, an exterior side, and a lower edge remote from the top wall, wherein the exterior side of the neck and the interior side of the skirt have cooperating rotational connection members, wherein the cap has two diametrically opposite wing parts, which are integrally moulded of plastic material and extend in a vertical plane outward from said skirt in a lateral direction over a wing part length, wherein each wing part has a base portion embodied as a wing panel, and an adjoining top portion with a top protrusion, and wherein each top protrusion, in a top view of the cap, extends outside the wing panel and in the opening direction or in a direction opposite to the opening direction, wherein, along each top protrusion length, a vertical cross-sectional area of each wing part defines an overturned L-shape.

15. A container provided with a closure assembly according to claim 11.

16. A container provided with a closure assembly according to claim 14.

17. A collapsible pouch provided with a closure assembly according to claim 11, wherein the pouch has a top edge and wherein the spout seal portion is sealed between two pouch walls in a top edge seal of the pouch that extends in the lateral direction, wherein the wings parts of the cap, in said closed position of the cap, extend in said lateral direction and parallel to a vertical plane of the top edge of the collapsible pouch.

18. A collapsible pouch provided with a closure assembly according to claim 14, wherein the pouch has a top edge and wherein the spout seal portion is sealed between two pouch walls in a top edge seal of the pouch that extends in the lateral direction, wherein the wings parts of the cap, in said closed position of the cap, extend in said lateral direction and parallel to a vertical plane of the top edge of the collapsible pouch.

* * * * *